US005741752A

United States Patent [19]

Goto et al.

[11] Patent Number: 5,741,752

[45] Date of Patent: *Apr. 21, 1998

[54] TRANSPARENT THERMAL RECORDING MEDIUM

[75] Inventors: Hiroshi Goto, Fuji; Hideaki Ema, Shimizumachi; Kiyoshi Sakai, Numazu, all of Japan

[73] Assignee: Ricoh Company, Ltd., Tokyo, Japan

[ * ] Notice: The term of this patent shall not extend beyond the expiration date of Pat. No. 5,380,693.

[21] Appl. No.: 479,354

[22] Filed: Jun. 7, 1995

Related U.S. Application Data

[63] Continuation-in-part of Ser. No. 355,903, Dec. 14, 1994, abandoned.

[30] Foreign Application Priority Data

| | | | |
|---|---|---|---|
| Dec. 15, 1993 | [JP] | Japan | 5-343113 |
| Jun. 9, 1994 | [JP] | Japan | 6-151481 |
| Sep. 2, 1994 | [JP] | Japan | 6-234326 |
| Dec. 9, 1994 | [JP] | Japan | 6-331855 |

[51] Int. Cl.[6] ..... B41M 5/30; B41M 5/40

[52] U.S. Cl. ..... 503/221; 427/152; 503/216; 503/217; 503/226

[58] Field of Search ..... 427/152; 503/200, 503/221, 226, 216, 217

[56] References Cited

U.S. PATENT DOCUMENTS

| | | | |
|---|---|---|---|
| 5,380,693 | 1/1995 | Goto | 503/200 |
| 5,403,810 | 4/1995 | Sawamura et al. | 503/201 |

FOREIGN PATENT DOCUMENTS

| | | | |
|---|---|---|---|
| 0 247 816 | 12/1987 | European Pat. Off. . | |
| 5-104859 | 4/1993 | Japan | 503/226 |

OTHER PUBLICATIONS

Patent Abstracts of Japan, vol. 13, No. 311 (M–851) (3659), Jul. 17, 1989, JP–1–99873, Apr. 18, 1989.

Patent Abstracts of Japan, vol. 18, No. 206 (M–1591) (6546), Apr. 12, 1994, JP–6–8626, Jan. 18, 1994.

*Primary Examiner*—Bruce H. Hess

*Attorney, Agent, or Firm*—Oblon, Spivak, McClelland, Maier & Neustadt, P.C.

[57] ABSTRACT

This invention provides a transparent thermal recording medium, in which the transparent thermal recording medium comprises: a thermal recording layer, which is provided on a transparent layer, consisting essentially of an electron-donating chromophoric compound, an electron-accepting compound and binder resin; and a further-provided protective layer having an approximately equal refractive index to the refractive index of the thermal recording layer, wherein the binder resin is a compound having a group selected from a hydroxyl group and a carboxyl group. The transparent thermal recording medium can be effectively used for a block copy film, on which an image is formed, for plate-making, particularly, in photogravure, offset printing and screen process printing, because the transparent thermal recording medium has a contrast of light transmission factors between a color-imaging portion and a non-imaging portion, in which the contrast is not less than 50% at a wavelength ranging from 370 nm to 450 nm.

7 Claims, No Drawings

TRANSPARENT THERMAL RECORDING MEDIUM

This application is a continuation-in-part of U.S. application Ser. No. 08/355,903, filed Dec. 14, 1994, now abandoned.

BACKGROUND OF THE INVENTION (1) Field of the Invention

The present invention relates to a thermal recording medium based on a coloration reaction of an electron-donating chromophoric compound with an electron-accepting compound and, in particular, a transparent thermal recording medium which is useful for a sheet of a block copy film (for image forming) for plate-making in gravure printing, offset lithography and screen process printing, more particularly, screen process printing for dyeing, an image-forming film sheet for an overhead projector (hereinafter referred to as an "OHP"), an image forming film for a CAD system and a geologic map.

(2) Description of the Prior Art

The above-mentioned thermal recording medium, which is based on the coloration reaction of the electron-donating chromophoric compound (hereinafter also referred to as a "color-producing agent"), is well known in the art.

Application of the thermal recording medium has been required to be expanded for various purposes such as the OHP, a sub origin in diazo process and designing of drawings. Furthermore, the thermal recording medium has been required to be used for the block copy film for the gravure printing, the offset lithography and the screen printing.

General requirements for properties of the block copy film are listed as follows:

(1) A light-shielding property at a wavelength corresponding to ultraviolet light is required to be achieved in one portion of the block copy film, where the ultraviolet light should be shielded, and a transparency of the light is required to be obtained in another portion, where the light should be transparent.

(2) The light-shielding property and the transparency of the light due to a change in a temperature, a moisture and light do not change too significantly during a desired interval (preservability).

(3) A visibility for inspecting a positioning error and a misprint between some superimposed block copy films (inspectability) is required.

(4) A precise dimensional accuracy is required.

(5) A high resolution is required.

(6) A physical strength capable of recycling is required.

The known thermal recording medium for the block copy film does not yet achieve the above-mentioned requirements.

The transparent thermal recording medium are described in Japanese Patent Application No.61-121875 and Japanese Laid-Open Patent Application No.1-99873, in which an image can be recorded directly on the transparent thermal recording medium with a thermal head. However, it is a problem that a complicated process described below is required to produce such a transparent thermal recording medium. For example, the color-producing agent must be wrapped with a microcapsule, and application liquid, which comprises an emulsified dispersion material formed by emulsifying and dispersing a developer dissolved in an organic solvent which is slightly soluble or insoluble in water, must be applied on a transparent support. On one hand, the thermal recording medium formed in the above-mentioned way has an insufficient transparency.

On the other hand, other transparent thermal recording media of a good transparency have a disadvantage that a stability of a coloring-image formed by the thermal energy is low. The transparent thermal recording media, used for the block copy film for plate-making, have a low contrast between a color-imaging portion and a non-imaging portion at a wavelength rang from 370 nm to 450 nm, so that the transparent thermal recording media can not be used for the block copy film for photosensitive plate-making when the block copy film utilizes a lamp having a wavelength rang from 370 nm to 450 nm.

Furthermore, the conventional transparent thermal recording medium has another problem that an offset between images printed on the respective films can hardly be found during an inspection of the block copy film formed, for example, by an automatic tracer, since the conventional transparent thermal recording medium has a coloring tone of substantially black and more than two block copy films are superimposed together on the inspection.

In other words, the color-imaging portion of the block copy film has a high absorption of the light at the wavelength ranging from 450 nm to 600 nm, which is particularly visible by visual inspection, and is deemed to be black, and thus results in a difficulty in determing whether the imaging portions of the superimposed block copy films are registerd together.

SUMMARY OF THE INVENTION

Accordingly, it is a general object of the present invention to provide a novel and useful transparent thermal recording medium based on a coloration reaction of an electron-donating chromophoric compound with an electron-accepting compound, in which the above-mentioned problems are overcome and the transparent thermal recording medium has a high enough contrast between light transmission factors of a color-imaging portion and a non-imaging portion and has an effective coloring tone for inspecting an image-formed block copy film to be useful for a block copy film sheet for plate-making.

To this end, according to the present invention a transparent thermal recording medium is provided, in which the transparent thermal recording medium comprises:

a thermal recording layer, which is provided on a transparent layer, consisting essentially of an electron-donating chromophoric compound, an electron-accepting compound and binder resin; and a further-provided protective layer having an approximately equal refractive index to the refractive index of said thermal recording layer, wherein said binder resin is a compound having a hydroxyl group and/or a carboxyl group.

According to the present invention, the transparent thermal recording medium is further provided, wherein the refractive index of said binder resin and the refractive index of resin forming said protective layer range from 1.45 to 1.60 at ordinary temperature.

According to the present invention, a transparent thermal recording medium is provided, in which the transparent thermal recording medium comprises: a supporting member, and a thermal recording layer provided on the supporting member, the thermal recording layer including an electron-donating chromophoric compound, an electron-acceptingcompound and a binder resin, wherein a light transmission factor of non-imaging portion of the thermal recording medium is over 35% at a wavelength ranging from 380 nm to 620 nm, and a light transmission factor of a color-producing imaging portion of the thermal recording medium is under 10% at a wavelength ranging from 380 nm to 620 nm.

According to the present invention, a transparent thermal recording medium is provided, in which the transparent thermal recording medium comprises: a supporting member, and a thermal recording layer provided on the supporting member, the thermal recording layer including an electron-donating chromophoric compound, an electron-accepting compound and a binder resin, wherein the thermal recording medium has a high light transmision factor at a wavelength ranging from 350 nm to 700 nm, a color-producing imaging portion of the thermal recording medium formed by thermal energy having absorption peaks at a wavelength ranging from 350 nm to 470 nm and a wavelength ranging from 470 nm to 700 nm respectively, a difference in light transmission factor between the color-producing imaging poriton and a non-imaging portion being over 35%.

According to the present invention, a transparent thermal recording medium is provided, in which the transparent thermal recording medium comprises: a supporting member, and a thermal recording layer provided on the supporting member, the thermal recording layer including an electron-donating chromophoric compound, an electron-accepting compound and a binder resin, wherein the thermal recording medium has a high light transmision factor at a wavelength ranging from 350 nm to 700 nm, a color-producing imaging portion of the thermal recording medium formed by thermal energy having absorption peaks at a wavelength ranging from 350 nm to 470 nm and a wavelength ranging from 470 nm to 700 nm respectively, a difference in light transmission factor between the color-producing imaging poriton and a non-imaging portion being over 35% at a wavelength ranging from 380 nm to 620 nm.

In the above invention, the binder resin has a hydroxyl group and/or a carboxyl group in a molecule thereof and the refractive index of resin thereof ranges from 1.45 to 1.60 at ordinary temperature. Also, the binder resin has the same refractive index as that of the protective layer.

The transparent thermal recording medium is also provided, wherein said electron-accepting compound is an organo phosphoric acid compound.

Still further, according to the present invention, the transparent thermal recording medium is provided, wherein said organo phosphoric acid compound is selected from phosphonic acid compounds of the following general formulas (I) and (II):

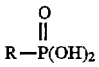

(I)

where R is selected from linear alkyl groups having from 16 to 24 carbon atoms; and

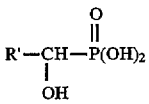

(II)

where R' is selected from linear alkyl groups having from 13 to 23 carbon atoms.

Still further, according to the present invention the transparent thermal recording medium is provided, wherein said electron-donating chromophoric compound is selected from fluoran compounds of the following general formulas (III), (IV), (V), (VI), (VII) and (VIII):

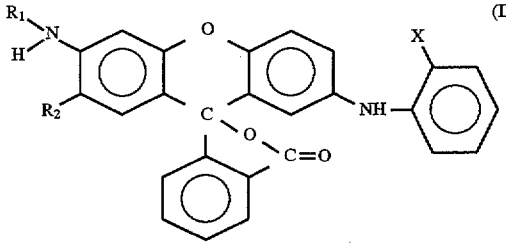

(III)

where $R_1$ is selected from alkyl groups having equal to or less than 8 carbon atoms, $R_2$ is selected from a hydrogen atom and an alkyl group having equal to or less than 4 carbon atoms, and X represents a halogen atom selected from a fluorine atom, a chroline atom and a bromine atom;

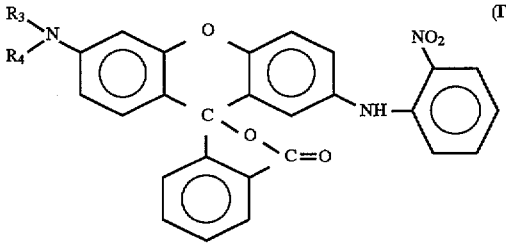

(IV)

where $R_3$ is selected from a hydrogen atom and an alkyl group having equal to or less than 8 carbon atoms, and $R_4$ is selected from alkyl groups having equal to or less than 8 carbon atoms;

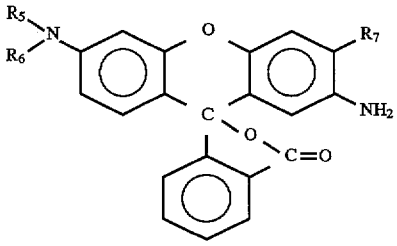

(V)

where $R_5$ and $R_6$ are selected from alkyl groups having equal to or less than 8 carbon atoms, and $R_7$ is selected from a hydrogen atom, a lower alkyl group and a lower alkoxy group;

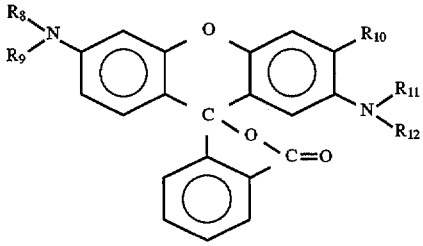

(VI)

where $R_8$ represents a hydrogen atom, $R_9$ represents an alkyl group having equal to or less than 8 carbon atoms, $R_{10}$ is selected from a hydrogen atom, a lower alkyl group and a lower alkoxy group, $R_{11}$ is selected from a hydrogen atom and an alkyl group having equal to and less than 8 carbon atoms, and $R_{12}$ is selected from an alkyl group having equal to or less than 8 carbon atoms, a phenyl group and a substituted phenyl group;

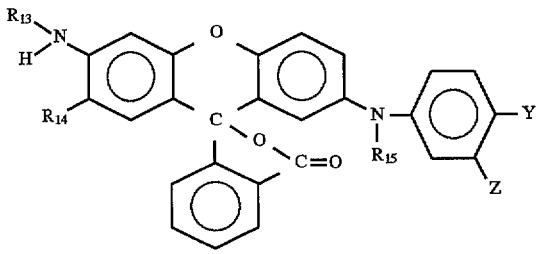

(VII)

where $R_{13}$ represents an alkyl group having equal to or less than 8 carbon atoms, $R_{14}$ is selected from a methyl group and an ethyl group, $R_{15}$ is selected from a hydrogen atom and an alkyl group having equal to or less than 4 carbon atoms, and Y and Z are selected from halogen atoms such as fluorine atoms, chlorine atoms and bromine atoms; and

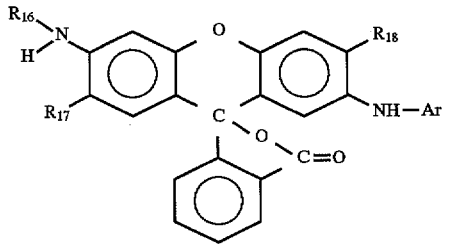

(VIII)

where $R_{16}$ represents an alkyl group having equal to or less than 8 carbon atoms, $R_{17}$ is selected from a methyl group and an ethyl group, $R_{18}$ is selected from an alkyl group having equal to or less than 4 carbon atoms and a halogen atom such as a fluorine atom, a chlorine atom and a bromine atom, and Ar is selected from a phenyl group and a benzyl group.

Still further, according to the present invention, a transparent thermal recording medium is provided, in which the transparent thermal recording medium comprises: a thermal recording layer provided on a transparent support, wherein said thermal recording layer consists essentially of an electron-donating chromophoric compound, an organo phosphoric acid compound, and binder resin having a refractive index ranging from 1.45 to 1.60 at ordinary temperature and including a hydroxyl group and/or a carboxyl group; and a protective layer provided on said thermal recording layer, said protective layer consisting essentially of resin having a refractive index ranging from 1.45 to 1.60 at ordinary temperature.

Still further, a transparent thermal recording medium is provided, in which the transparent thermal recording medium comprises: a thermal recording layer provided on a transparent support, wherein said thermal recording layer consists essentially of an electron-donating chromophoric compound, an organo phosphoric acid compound, and binder resin having a refractive index ranging from 1.45 to 1.60 at ordinary temperature and including a hydroxyl group and/or a carboxyl group; and a protective layer provided on said thermal recording layer, said protective layer consisting essentially of resin having a refractive index ranging from 1.45 to 1.60 at ordinary temperature, wherein a difference of light transmission factors between a color-producing imaging portion formed on the transparent thermal recording medium by a thermal energy and a non-imaging portion is over 35% at a wavelength ranging from 380 nm to 440 nm.

Yet, further, according to the present invention, a block copy film is formed of the above-mentioned transparent thermal recording medium by applying a thermal energy, wherein a difference of light transmission factors between a color-producing imaging portion formed on the block copy film by a thermal energy and a non-imaging portion is over 35% at a wavelength ranging from 380 nm to 440nm. The difference of the light transmission factor (A %) is determined by a light transmission factor in a non-imaging portion (B %) and a light transmission factor in a imaging portion (C %) according to the following equation.

$$A=B-C$$

DESCRIPTION OF THE PREFERRED EMBODIMENTS

The above and other objects, features, and advantages of the present invention will be more apparent from the following detailed description.

A description will now be given of an embodiment of a transparent thermal recording medium according to the present invention.

An electron-donating chromophoric compound according to an embodiment of the present invention is per se an achromatic or pale dye precursor, and a fluoran compound is a non-limiting example of typically known electron-donating chromophoric compounds. For example, the fluoran compound can be selected from the following compounds.

3-diethylamino-7-anilinofluoran
3-di-n-butylamino-7-anilinofluoran
3-(N-n-hexyl-N-ethylamino)-7-anilinofluoran
3-diethylamino-7-dibenzylaminofluoran
3-diethylamino-5-methyl-7-dibenzylaminofluoran
3-diethylamino-7-piperidinofluoran
3-diethylamino-7-(o-chloranilino)fluoran
3-di-n-butylamino-7-(o-chloranilino)fluoran
3-dimethylamino-6-methyl-7-anilinofluoran
3-diethylamino-6-methyl-7-anilinofluoran
3-di-n-butylamino-6-methyl-7-anilinofluoran
3-(N-n-propyl-N-methylamino)-6-methyl-7-anilinofluoran
3-(N-iso-propyl-N-methylamino)-6-methyl-7-anilinofluoran
3-(N-n-butyl-N-ethylamino)-6-methyl-7-anilinofluoran
3-(N-iso-butyl-N-methylamino)-6-methyl-7-anilinofluoran
3-(N-n-amyl-N-methylamino)-6-methyl-7-anilinofluoran
3-(N-iso-amyl-N-ethylamino)-6-methyl-7-anilinofluoran
3-(N-cyclohexyl-N-methyl)-6-methyl-7-anilinofluoran
3-(N-n-amyl-N-ethylamino)-6-methyl-7-anilinofluoran
3-(N-p-tolyl-N-ethylamino)-6-methyl-7-anilinofluoran
3-(N-2-ethoxypropyl-N-ethylamino)-6-methyl-7-anilinofluoran
3-pyrrolidino-6-methyl-7-anilinofluoran
3-(N-tetrahydrofurfuryl-N-ethylamino)-6-methyl-7-anilinofluoran
3-diethylamino-7-(m-trifluoromethylanilino)fluoran
3-diethylamino-6-methyl-7-(2',4'-dimethylanilino)fluoran
3-diethylamino-6-chlor-7-anilinofluoran
3-diethylamino-5-methyl-7-(α-phenylethylamino)fluoran
3-(N-p-tolyl-N-ethylamino)-7-(α-phenylethylamino)fluoran A color-producing agent according to the present invention is preferably selected from fluoran compounds of the general formulas (III), (IV), (V), (VI), (VII) and (VIII). An embodiment of the color-producing agent can be selected from the following compounds.

Embodiments of the general formula (III)

2-(O-chlorophenylamino)-6-ethylamino-7-methylfluoran
2-(O-chlorophenylamino)-6-n-butylamino-7-methylfluoran
2-(O-phlorophenylamino)-6-ethylamino-7-methylfluoran
2-(O-chlorophenylamino)-6-n-butylaminofluoran
2-(O-chlorophenylamino)-6-n-hexylaminofluoran 2-(O-chlorophenylamino)-6-n-octylaminofluoran
2-(O-phlorophenylamino)-6-iso-amylaminofluoran
2-(O-phlorophenylamino)-6-n-octylaminofluoran
Embodiments of the general formula (IV)
2-(O-nitrophenylamino)-6-diethylaminofluoran
2-(O-nitrophenylamino)-6-di-butylaminofluoran
2-(O-nitrophenylamino)-6-(N-ethyl-N-n-butylamino) fluoran
2-(O-nitrophenylamino)-6-(N-ethyl-N-iso-amylamino) fluoran
Embodiments of the general formula (V)
2-amino-6-diethylaminofluoran
2-amino-6-di-n-butylaminofluoran
2-amino-3-methyl-6-diethylaminofluoran
2-amino-3-methyl-6-di-n-butylaminofluoran
2-amino-3-methyl-6-(N-ethyl-N-iso-amylamino)fluoran
2-amino-3-methoxy-6-diethylaminofluoran
2-amino-3-methoxy-6-di-n-butylaminofluoran
Embodiments of the general formula (VI)
2-methylamino-6-n-butylaminofluoran
2-n-butylamino-6-n-butylaminofluoran
2-n-octylamino-6-n-ethylaminofluoran
2-n-octylamino-3-methyl-6-n-butylaminofluoran
2-phenylamino-6-ethylaminofluoran
2-phenylamino-6-n-butylaminofluoran
2-phenylamino-6-n-octylaminofluoran
2-phenylamino-3-methyl-6-n-butylaminofluoran
2-phenylamino-3-methyl-6-ethylaminofluoran
2-phenylamino-3-methyl-6-n-hexylaminofluoran
2-phenylamino-3-methyl-6-n-amylaminofluoran
2-phenylamino-3-methyl-6-iso-amylaminofluoran
2-phenylamino-3-methyl-6-n-octylaminofluoran
2-phenylamino-3-methoxy-6-n-butylaminofluoran
2-phenylamino-3-methoxy-6-n-hexylaminofluoran
Embodiments of the general formula (VII)
2-(3',4'-dichlorophenylamino)-6-ethylamino-7-methylfluoran
2-(3',4'-dichlorophenylamino)-6-n-butylamino-7-methylfluoran
2-(3'-chloro-4'-fluorophenylamino)-6-ethylamino-7-methylfluoran
2-(N'-methyl-N-3'-chlorophenylamino)-6-ethylamino-7-methylfluoran
2-(N-ethyl-N-3'-chlorophenylamino)-6-ethylamino-7-methylfluoran
2-(N-methyl-N-4'-chlorophenylamino)-6-ethylamino-7-methylfluoran
Embodiments of the general formula (VIII)
2-phenylamino-3-methyl-6-ethylamino-7-methylfluoran
2-phenylamino-3-methyl-6-n-butylamino-7-methylfluoran
2-phenylamino-3-ethyl-6-ethylamino-7-methylfluoran
2-benzylamino-3-methyl-6-ethylamino-7-methylfluoran
2-phenylamino-3-chloro-6-ethylamino-7-methylfluoran
2-phenylamino-3-chloro-6-N-butylamino-7-methylfluoran
2-benzylamino-3-chloro-6-ethylamino-7-methylfluoran According to the embodiment of the present invention, a developer for coloring the above-described color-producing agent is preferably selected from a phenol compound and an organo phosphoric acid compound. For example, an embodiment of the phenol compound is selected from a gallic acid compound, a protocatechuic acid compound and a bis(hydroxyphenyl)acetic acid. An embodiment of the organo phosphoric acid compound is selected from an alkylphosphonic acid compound and an α-hydroxyalkylphosphonate. The organo phosphoric acid is excellent in surface blushing and thermal sensitivity.

The organo phosphoric acid is preferably selected from a phosphonate of the general formulas (I) and (II):

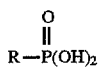

(I)

where R is selected from linear alkyl groups having from 16 to 24 carbon atoms; and

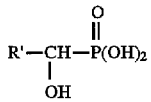

(II)

where R' is selected from linear alkyl groups having from 13 to 23 carbon atoms.

An embodiment of the phosphonic acid compound of the general formula (I) may be selected from hexadecylphosphonate, octadecylphosphonate, eicosylphosphonate, docosylphosphonate and tetracosylphosphonate.

An embodiment of the phosphonic acid compound of the general formula (II) may be selected from α-hydroxytetradecylphosphonate, α-hydroxyhexadecylphosphonate, α-hydroxyoctadecylphosphonate, α-hydroxyeicosylphosphonate and α-hydroxytetracosylphosphonate.

According to the present invention, either one developer solely or a mixture of two or more developers can be employed. Either of one color-producing agent or a mixture of two or more color-producing agents can also be employed.

An average particle size of the developer according to the present invention is preferably equal to or less than 10 μm, and more preferably, the average particle size is equal to or less than 1 μm and the maximum particle size of the developer is not more than 1 μm, so that a thermal sensitivity and a resolution of the thermal recording medium can be improved.

Conditions required for a binder included in a thermal recording layer is described hereinafter. When a coloration reaction of the color-producing agent with the developer is generated, for example, by a thermal energy, protons from the developer may attack the color-producing agent so as to enrich a periphery of a dye coloring body, being colored by a ring-opening, with the protons, thus allowing the coloring body to remain stable and preventing the coloring dye from fading. Therefore, it is preferable that the binder resin is selected from compounds including, for example, a hydroxyl group and/or a carboxylic acid group to satisfy the above-mentioned requirements, and more preferably, that the compound has a refractive index (hereinafter also referred to as R.I.) ranging from 1.45 to 1.60 at ordinary temperature.

This binder resin is selected from poly(vinyl butylal): R.I.=1.48 to 1.49, poly(vinyl acetal): R.I.=1.50, epoxy resin: R.I.=1.55 to 1.61, ethyl cellulose: R.I.=1.46 to 1.49, cellulose acetate: R.I.=1.46 to 1.50, cellulose acetate butylate: R.I.=1.46 to 1.49, cellulose acetate propionate: R.I.=1.46 to 1.49, nitro cellulose: R.I.=1.49 to 1.51 and styrene-maleic acid monoalkylester: R.I.=1.50 to 1.51.

Also, oxide as impurities included in the binder resin, and the ultraviolet absorbing agent and antioxidant agent having a hydroxyl group or a carboxyl group in a molecule can perform the same function as the above binder resin.

An improvement of a light stability of the thermal recording medium according to the present invention can be achieved by including a light stabilizer in either the thermal recording layer or the protective layer. According to the present invention the light stabilizer may be selected from an ultraviolet absorber, an antioxidant, an anti-aging agent, an extinctive agent of a singlet enzyme and an extinctive agent of a superoxide anion.

The ultraviolet absorber, for example, may be selected from a benzophenone ultraviolet absorber such as 2,4-dihydroxybenzophenone, 2-hydroxy-4-methoxybenzophenone, 2-hydroxy-4-n-octoxybenzophenone, 4-dodecyloxy-2-hydroxybenzophenone, 2,2'-dihydroxy-4-methoxybenzophenone, 2,2'-dihydroxy-4,4'-dimethoxybenzophenone, 2,2',1,4'-tetrahydroxybenzophenone, 2-hydroxy-4-methoxy-2'-carboxybenzophenone, 2-hydroxy-4-oxybenzylbenzophenone, 2-hydroxy-4-chlorobenzophenone, 2-hydroxy-5-chlorobenzophenone, 2-hydroxy-4-methoxy-4'-methylbenzophenone, 2-hydroxy-4-n-heptoxybenzophenone, 2-hydroxy-3,6-dichlor-4-methoxybenzophenone, 2-hydroxy-3,6-dichlor-4-ethoxybenzophenone and 2-hydroxy-4-(2-hydroxy-3-methylacryloxy)propoxybenzophenone; a benzotriazol ultraviolet absorber such as 2-(2'-hydroxy-5'-methylphenyl) benzotriazol, 2-(2'-hydroxy-3',5'-ditertiary-butylphenyl) benzotriazol, 2-(2'-hydroxy-3'-tertiary-butyl-5'-methylphenyl)benzotriazol, 2-(2'-hydroxy-4'-octoxy) benzotriazol, 2-(2'-hydroxy-3',5'-ditertiary-butylphenyl)5-chlorobenzotriazol, 2-(3'-tertiary-butyl-2'-hydroxy-5'-methylphenyl)5-chlorobenzotriazol and 2-(2'-hydroxy-5-ethoxyphenyl)benzotriazol; a salicylic acid phenyl ester ultraviolet absorber such as phenyl salicylate, P-octylphenyl salicylate, P-tertiary-butylphenyl salicylate, carboxylphenyl salicylate, methylphenyl salicylate and dodecylphenyl salicylate; P-methoxybenzyliden malonic acid dimethyl ester; 2-ethylhexyl-2-cyano-3,3'-diphenylacrylate; ethyl-2-cyano-3,3'-diphenylacrylate; 3,5-ditertiary-butyl-P-hydroxybenzoic acid; resorcinol monobenzoate; 2,4-ditertiary-butylphenyl; 3,5-ditertiary-butyl-4-hydroxybenzoate; and the like.

The antioxidant and the anti-aging agent may be selected, for example, from 2,6-ditertiary-butyl-4-methylphenol, 2,4,6-tritertiarybutylphenol, styrene modified phenol, 2,2'-methylenebis(4-methyl-6-tertiarybutylphenol), 4,4'-isopropylidenebisphenol, 2,6-bis(2'-hydroxy-3'-tertiarybutyl-5'-methylbenzyl)-4-methylphenol, 4,4'-thiobis-(3-methyl-6-tertiarybutylpheno 1), tetrakis-{methylene(3,5-ditertiarybutyl-4-hydroxyhydrocinnamate)}methane, parahydroxyphenyl-3-naphthylamine, 2,2,4-trimethyl-1,2-dihydroquinoline, thiobis(β-naphthol), mercaptobenzothiazole, mercaptobenzimidazole, aldol-2-naphthylamine, bis(2,2,6,6-tetramethyl-4-piperidyl) sebacate, 2,2,6,6-tetramethyl-4-piperidylbenzoate, dilauryl-3,3'-thiodipropionate, distearyl-3,3'-thiodipropinate, tris(4-nonylphenol)phosphate, and the like.

The extinctive agent of the singlet enzyme may be selected from a caroten class, a pigment class, an amine class, a phenol class, a nickel complex group and a sulfide class.

An embodiment of the extinctive agent of the singlet enzyme may be, for example, selected from 1,4-diazabicyclo(2,2,2)octane, β-catoten, 1,3-cyclohexadiene, 2-diethylaminomethylfuran, 2-phenylaminomethylfuran, 9-diethylaminomethylanthracene, 5-diethylaminomethyl-6-phenyl-3,4-dihydroxypyran, nickeldimethyldithiocarbamate, nickeldibutyldithiocarbamate, nickel-3,5-di-t-butyl-4-hydroxybenzyl-O-ethylephosphonate, nickel-3,5-di-t-butyl-4-hydroxybenzyl-O-butylphosphonate, nickel{2,2'-thiobis(4-t-octylphenolate)}(n-butylamine), nickel{2,2'-thiobis(4-t-octylphenolate)}(2-ethylhexylamine), nickelbis{2,2'-thiobis(4-t-octylphenolate)}, nickelbis{2,2'-sulfonebis(4-octylphenolate)}, nickelbis(2hydroxy-5-methoxyphenyl-N-n-butylaldoimine), nickelbis(dithiobenzyl), nickelbis (dithiobiacetyl) and so on.

A non-limiting example of the extinctive agent of the superoxide anion according to the present invention may be selected from superoxidedismutase, a cobalt[III] complex and a nickel[II] complex. These are used solely or in a mixture of more than two thereof.

A substrate of the thermal recording medium according to the present invention is a transparent support, which preferably has a refractive index ranging from 1.45 to 1.60 at ordinary temperature. For example, the transparent support can be generally selected from a polyester film such as poly(ethylene terephthalate) and poly(butylene terephthalate); a cellulose derivative film such as cellulose triacetate; a polyolefin film such as polypropylene and polyethylene; a polystyrene film; and a laminate thereof. It is preferable that an adhesive layer is inserted between the thermal recording layer and the transparent support. The adhesive layer may be generally formed of acryl resin, saturated polyester resin and hardened resin thereof.

In case of the thermal recording medium having no protective layers, the thermal recording layer contains fine particles of the developer dispersed in the binder resin, so that a surface and an inside of the thermal recording layer is inhomogeneous. Since this inhomogeneity results in a presence of air in an unevenness or vacancy of the thermal recording layer and a difference of the refractive index in the thermal recording layer, light thus being scattered, the thermal recording layer appears to be opaque or semitransparent. However, according to the thermal recording medium of the present invention, the unevenness and the vacancy of the thermal recording layer can be removed by applying and drying (hardening) some resin on the opaque or semitransparent recording layer, in which the resin has the same refractive index at ordinary temperature as that of the binder resin of the thermal recording layer, and thus the thermal recoding layer remains homogeneous. This eliminates the light scattering and improves the transparency of the thermal recording medium. The resulting protective layer not only contributes to transparency of the medium, but also effectively improves chemical resistance, water resistance, abrasion resistance, light fastness and a head matching property. Therefore, the protective layer is an essential component of the high performance transparent thermal recording medium.

The protective layer according to the present invention includes a coating formed principally of water-soluble resin or hydrophobic resin as well as a coating formed principally of ultraviolet curable resin or electron beam curable resin. Due to the formation of such a protective layer, the thermal recording medium with no practical problems can be achieved even if an organic solvent, a plasticizer, oil, sweat and water contact with the thermal recording medium. Furthermore, an inclusion of an organic or inorganic filler and a slippable agent results in the thermal recording medium of high reliability and high head matching quality while preventing, for example, the medium being stuck by contacting with the thermal head.

A detail description of the protective layer according to the present invention will be given hereinafter. The protective layer of the present invention comprises resin having substantially the same refractive index as that of the binder resin forming the thermal recording layer. An acceptable difference between those refractive indexes, which are substantially equal to each other, ranges from approximately −5% to +5%. The resin preferably has the refractive index ranging from 1.45 to 1.60 at ordinary temperature.

The resin satisfying the above-mentioned requirement can be selected from water-soluble resin, water emulsion, hydrophobic resin, ultraviolet curable resin and electron beam curable resin. An embodiment of the water-soluble resin may be selected from polyvinyl alcohol, denatured polyvinyl alcohol, cellulose derivatives (methylcellulose, methoxycellulose, hydroxyethylcellulose and so on), casein, gelatin, polyvinyl pyrrolidone, a styrene-maleic anhydride copolymer, a diisobutylene-maleic anhydride copolymer, polyacrylamide, modified polyacrylamide, a methylvinyl ether-maleic anhydride copolymer, carboxy modified polyethylene, a polyvinyul alcohol/acrylamide block copolymer, melamine-formaldehyde resin, urea-formaldehyde resin and so on. An embodiment of the water emulsion resin and the hydrophobic resin may be selected from polyvinyl acetate, polyurethane, a stylene/butadiene copolymer, a styren/butadiene/acryl copolymer, polyacrylic acid, polyacrylate, a vinyl chloride/vinylacetate copolymer, polybutyl methacrylate, an ethylene/vinylacetate copolymer and so on. These resin can be used individually or mixed together, and a hardner may also be added to the resin to harden the resin.

A detailed description of the ultraviolet curable resin and the electron beam curable resin, which are most preferred embodiments of the protective layer according to the present invention, is given hereinafter.

Various well-known monomers and oligomers (prepolymers), which are polymerized and hardened by emitting ultraviolet light so as to form resin and which are non-limiting examples, can be used for the ultraviolet curable resin for forming the protective layer. The monomer or oligomer is selected from (poly)ester acrylate, (poly) urethane acrylate, epoxy acrylate, polybutadiene acrylate, silicone acrylate and melamine acrylate. (Poly)ester acrylate is a reaction of polyhydric alcohol such as 1,6-hexanediol, propylene glycol (in a form of a propylene oxide) and diethylene glycol; polybasic acid such as adipic acid, phthalic anhydride and trimellitic acid; and acrylic acid. Formulas of the above-mentioned reaction products are written as follows.

(a) Adipic acid/1,6-hexanediol/acrylic acid:

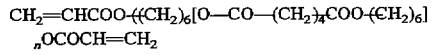

where n represents an integer varying from 1 to 10.

(b) Phthalic anhydride/propylene oxide/acrylic acid

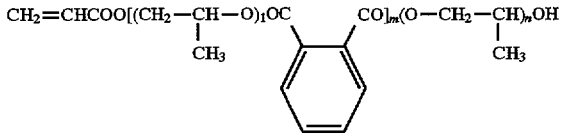

where 1 represents an integer varying from 1 to 10; m represents an integer varying from 1 to 10; and n represents an integer varying from 1 to 10.

(c) Trimellitic acid/diethylene glycol/acrylic acid

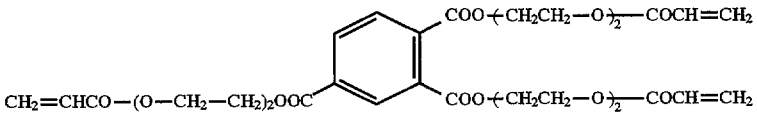

(Poly)urethane acrylate is a reactive production of a compound having an isocyanate group such as tolylene diisocyanate (TDI) with acrylate having a hydroxy group. A formula (IV) of the reactive production is written as follows.

(d) HEA/TD1/HDO/ADA/HDO/TDI/HEA

HEA represents 2-hydroxyethylacrylate; HDO represents 1,6-hexanediol; and ADA represents adipic acid:

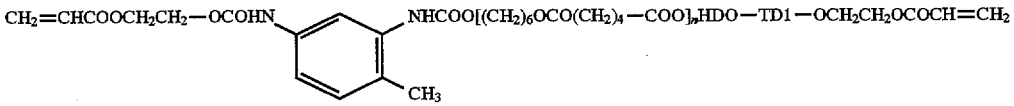

where n represents an integer varying from 1 to 10.

Epoxy acrylate is generally categorized into bisphenol type, novolac type and alicyclic type, in which an epoxy group of epoxy resin is acryl-modified with acrylic acid so that a functional group thereof is modified to an acryloyl group. Formulas of the epoxy acrylate are shown as follows.

(e) Bisphenol A-epichlorohydrin type/acrylic acid

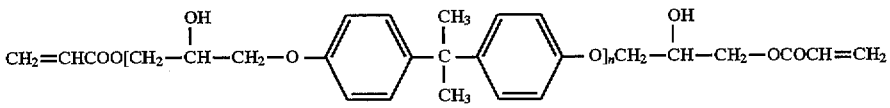

where n represents an integer varying from 1 to 15.

(f) Phenol novolac-epichlorohydrin type/acrlic acid

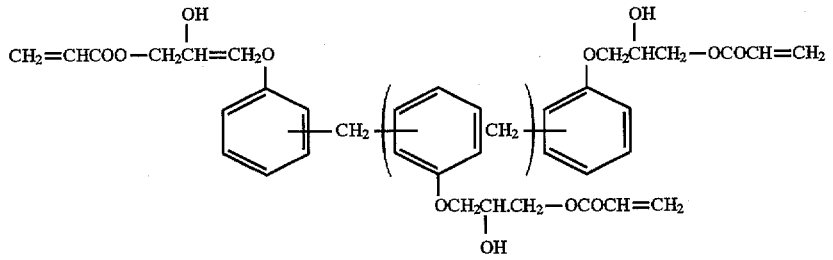

where n represents an integer varying from 0 to 5.

(g) Alicylic type/acrylic acid

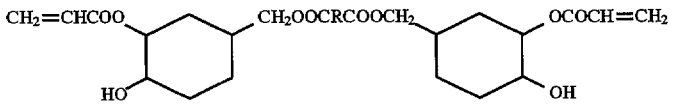

where R represents $-(CH_2)_n-$; and n represents an integer varying from 1 to 10.

Polybutadiene acrylate is, for example, a reactive production of 1,2-polybutadien acrylate including an OH end group with isocyanate or 1,2-mercaptoethanol and further being reacted with acrylic acid and so on.

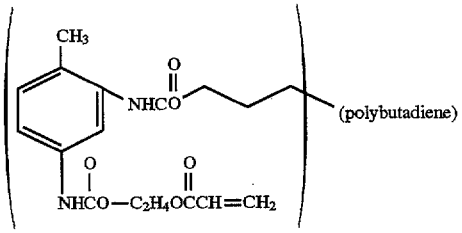

Silicone acrylate is, for example, prepared by a condensation reaction (demethanol reaction) of organic functional trimethoxysilane with polysiloxane including a silanol group so as to be methacryl-modified. A formula (i) of silicone acrylate is given as follows:

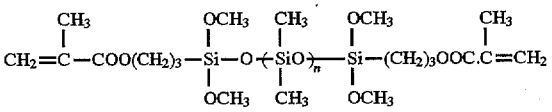

where n represents an integer varying from 10 to 14.

When the ultraviolet curable resin is used, a solvent is sometimes used with the resin. The solvent is, for example, selected from organic solvents such as tetrahydrofuran, methyl ethyl keton, methyl isobutyl keton, chloroform, carbon tetrachloride, ethanol, isopropyl alcohol, ethyl acetate, butyl acetate, toluene, benzene and so on. Alternately, a photopolymerizable monomer can be used for a reactive diluent to achieve an easy treatment.

The photopolymerizable monomer may be selected from 2-ethylhexyl acrylate, cyclohexyl acrylate, butoxyethyl acrylate, neopentylglycol diacrylate, 1,6-hexanediol diacrylate, polyethyleneglycol diacrylate, trimethylolpropane triacrylate, pentaerythrite acrylate and so on.

Next a detail description of the electron beam curable resin will be given hereinafter. Various non-limiting examples of the electron beam curable resin are available. In particular, a preferred embodiment of the electron beam curable resin comprises a branchingmmolecular structure having more than 5 functional groups of a polyester skeleton (hereinafter referred to as "electron beam curable acryl-modified polyuretane resin"), and another preferred embodiment is one which essentially consists of silicone-modified electron beam curable resin.

The electron beam curable acryl-modified polyurethane resin, for example, can be produced as follows.

First, polyester diol of one reactive production of 1,4-butadinol with adipic acid or another reactive production of propyleneglycol with adipic acid (both of them corresponding to the polyester skeleton) is mixed with polyether triol to achieve a mixture. Then diisocyanate and a compound having an acryl double bond are added to the mixture to react with the mixture, so as to produce the electron beam curable acryl-modified polyurethane resin.

A mixture of polyester diol with polyether triol, a mixture of polyester diol with polyester triol or polyether diol with polyester triol can be employed to prepare the electron beam curable acryl-modified polyurethane resin as an alternative to the mixture of the polyester diol with the polyether triol.

For example, diisocyanate may be selected from 2,4-tolylenediisocyanate, 2,6-tolylenediisocyanate, 1,6-hexamethylenediisocyanate, xylenediisocyanate, isophoronediisocyanate, methylenebis(4-phenylisocyanate) and so on. The compound having the acryl double bond, for example, can be selected from 2-hydroxyethyl(meta) acrylate, 2-hydroxypropyl(meta)acrylate, 3-hydroxypropyl (meta)acrylate and so on. Polyester diol is commercially available, for example, in a form of ADECANEWACE Y4-30 (produced by ASAHI DENNKAKOGYO Corp.) and polyether triol is also commercially available, for example, in a form of SUNNIX TP-400 or SUNNIX GP-3000 (produced by SANYO KASEI Corp.).

A molecular weight of a polyester portion of the electron beam curable acryl-modified polyurethane resin preferably ranges from 2000 to 4000 in order to achieve a desired flexibility and robustness in a heat resistance slip layer. Further, a total molecular weight of the electron beam curable acryl-modified polyurethane resin preferably ranges from 20000 to 50000 due to the same reason as described above. The resin having not less than 5 functional groups, and preferably 7 to 13 functional groups, can effectively cause a progress for hardening and an improvement of hardness.

The silicone-modified electron beam curable resin is written as the following formula:

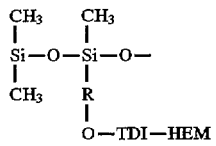

where R represents —$(CH_2)$—n, where n represents an integer varying from 0 to 3; TDI represents 2,4-tolylenediisocyanate; and HEM represents 2-hydroxyethyl acrylate, where x ranges from 50 to 100 and y ranges from 3 to 6.

This silicone-modified electron beam curable resin has a superior covering property to form a uniform thin coating fairly well and has an effective slip property due to a silicone functional group.

In simultaneous use of the electron beam curable acryl-modified resin and the electron beam silicone-modified resin, it is preferable that 30 parts by weight, and more preferably 5 to 20 parts by weight, electron beam silicone-modified resin may be added to 100 parts by weight electron beam curable acryl-modified resin.

In the protective layer according to the present invention, it is preferable that a multi-sensitive electron beam curable monomer is employed simultaneouly in order to progress the hardening while forming the layer and to improve the heat resistance of the layer. This monomer acts as a cross-linking stimulator and has an advantage in forming a complicated and high-density cross-linking structure.

An embodiment of the above-mentioned monomer can be selected from trimethylolpropaneacrylate, tetramethylolmethanetetraacrylate, pentaerythritoltriacrylate, dipentaerythritolhexatriacrylate and so on.

It is preferable that less than 50 parts monomer by weight, more preferably 20 to 50 parts by weight, are added to 100 parts by weight electron beam curable acryl-modified polyurethane resin. More than 50 parts monomer results in a weakness of lubricant hardening and a degradation of the slip effect.

Another embodiment of the protective layer according to the present invention is phosphazene resin having repeated units including a phosphazene skeleton of the following formula, and having significant heat resistance.

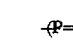

A more particular and non-limiting example of the phosphazene resin is written as the following formula:

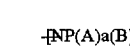

where a and b represent real numbers satisfying the following equations: a>0, b≧0 and a+b=2; A represents a polymerization curable group of the following formula such as a metaacryloyloxyethyl group:

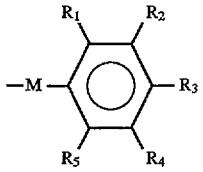

where $R_1$, $R_2$, $R_3$, $R_4$ and $R_5$ are selected from a hydrogen atom, a chlorine atom, a bromine atom and a halogenated alkyl group having from 1 to 4 carbon atoms; M is selected from an oxygen atom, a sulfur atom and an imino group.

One of the above-mentioned phosphazene resins, where A is a metaacryloyloxyethyl group and b is equal to 0, can be prepared by a ring-opening polymerization of a compound of the following formula:

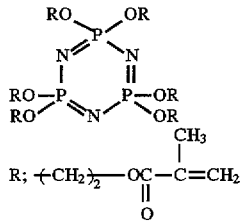

If the resin has the polymerization curable group as is the case with the phosphazene resin, a mechanical strength, hardness and heat resistance of the resin can be improved by hardening with ultraviolet rays, electron rays or heat.

The improvement of light stability of the protective layer according to the present invention is also achieved by the protective layer containing the same light stabilizer as that contained in the thermal recording layer as described above. The light stabilizer can be selected from the ultraviolet absorber, the antioxidant, the anti-aging agent, the extinctive agent of the single enzyme and the extinctive agent of the superoxide anion, which are all the same as those employed with the thermal recording layer.

The inclusion of the organic or inorganic filler and the slippable agent, to the extent that the transparency of the protective layer would not be degenerated, results in the improvement of the head matching property.

The organic filler employed in the present invention is selected from polyolefin particles, polystylene particles, urea-formaldehyde resin particles and plastic fine hollow spheral particles; and the inorganic filler is selected from aluminium hydroxide, heavy and light calcium carbonate, zinc oxide, titanium oxide, sulfur barium, silica gel, colloidal silica (from 10 to 50 mμm), alumina sol (from 10 to 200 mμm), activated clay, talc, clay titanium white, kaolinite, calcined kaolinite, diatom earth, synthetic kaolinite, a zirconium compound and a glass fine hollow sphere. In particular, the spherally shaped filler having the same slippable property as that of Si resin or fluorine resin is preferably employed.

A slippable additive may be selected from a slippable agent such as silicone oil, a surfactant, an organic salt and a class of wax; and a slippable filler.

The silicone oil is selected from dimethylpolysiloxane, methylphenylpolysiloxane, methylhydrodienepolysiloxane, alkyl-modified polysiloxane, carbon-modified polysiloxane and alcohol-modified polysiloxane.

The surfactant is selected from a commercially available carboxylate, sulfate ester salt of higher alcohol, sulfonate, phosphate of higher alcohol and salt thereof. A non-limiting embodiment of the surfactant can be selected from sodium laurate, sodium stearate, sodium oleate, lauryl alcohol sodium sulfate ester, myristyl alcohol sodium sulfate ester, cetyl alcohol sodium sulfate ester, stearyl alcohol sodium sulfate ester, oleyl alcohol sodium sulfate ester, sodium sulfate ester of an ethylene oxide adduct of higher alcohol, sodium octylsulfonate, sodium decylsulfonate, sodium dodecylsulfonate, sodium octylbenzene sulfonate, sodium dodecylbenzene sulfonate, potassium dodecylbenzene sulfonate, sodium nonylnaphthalene sulfonate, sodium dodecylnaphthalene sulfonate, potassium dodecylnaphthalene sulfonate, sodium N-oleyl-N-methyltaurine, tetraethoxylaurylalcohol acid ester, sodium monostearylester phosphate and sodium distearylesterphosphate.

The class of organic salts may be selected from metallic soap such as zinc stearate, aluminium stearate, calcium stearate, magnesium stearate; and a class of salts such as hexylammoniumchloride, sodium sulfosalicylate, sodium succinate, potassium succinate, potassium benzonate and potassium adipate.

The wax may be selected from natural wax such as candelilla wax, carnauba wax, rice wax, bees wax, lanolin wax, montan wax, paraffin wax and microcrystalline wax; and synthetic wax such as polyethylene wax, hydrogenated castor oil and derivatives thereof and fatty acid amide. An appropriate amount of the slippable agent in the protective layer ranges from 0.001 to 15.0% by weight. If the amount of the slippable agent exceeds the appropriate range, the mechanical strength of the protective layer degrades, and if the amount is less than the appropriate one, an effect of the slippable agent can not be achieved.

The transparent thermal recording medium according to the present invention can be prepared with one of the following methods. First the applying liquid is prepared in accordance with each of the methods. In the first method, solely the developer is homogeneously dispersed in the organic solvent, and then the color-producing agent and the binder resin in series are homogeneously mixed with the solvent to prepare the applying liquid for the thermal recording layer. In the second method, the developer is homogeneously dispersed in a solution of the binder resin, in which the binder resin is dissolved in the organic solvent, and the applying liquid for the thermal recording layer is prepared by homogeneously mixing the color-producing agent and so on with the solution. In the third method, the color-producing agent and the developer are dispersed in the organic solvent with the binder resin to prepare the applying liquid for the thermal recording layer. Then the applying liquid having been dispersed homogeneously by one of the above-mentioned ways is applied and dried on one side or both sides of the transparent support so as to provide the thermal recording layer on the support, and then the protective layer consisting essentially of the resin is provided on the thermal recording layer.

The organic solvent for dissolving the binder resin can be selected from a class of ethers such as dibutylether, isopropylether, dioxane and tetrahydrofuran; a class of ketones such as acetone, diethylketone, methylethylketone, methylisobutylketone and methylpropylketone; a class of esters such as ethyl acetate, isopropyl acetate and n-propyl acetate; and a class of aromatic hydrocarbons such as benzene, toluene and xylene. One of those compounds solely or a mixture of several of the compounds can be employed.

There are no limitations of the available method for coating the protective layer and the amount of the applied material. However, in consideration of a performance and an economy, the protective layer requires a thickness of the applied layer on the thermal recording medium to be from 0.1 to 20 μm, and preferably from 0.5 to 10 μm, so as to achieve enough performance of the protective layer and keep a capacity of the thermal recording medium.

Also, it is preferred that an antistatic layer is provided on the bottom side of the recording medium for easy handling thereof, preventing dust from being attached to the recording medium and improving image quality. As the electrostatic agent suitable even at low temperature, electrically conductive metal oxide compound can be listed.

Generally speaking, an antistatic agent including electrically conductive metal oxide is expensive. However, since metal oxide compound itself is electrically conductive, even a small amount of metal oxide compound performes great antistatic characteristics. Also, metal oxide compound does not prevent a production of transparent recording medium.

As the electrically conductive metal oxide, SnO2, In203, ZnO, TiO2, MgO, Al203, BaO or MoO3 can be used solely or these compounds can be used with P, Sb, Sn or Zn. However, the electrically conductive metal oxide is not limited to those listed above. It is preferred that particles of the electrical conductive metal oxide is fine to realize a transparent recording medium. In this invention, the average particle size is less than 0.2 μm to realize a transparent recording medium.

As a binder to be used with those, hydrophilic resin, hydrophilic emulsion, hydrophobic resin, ultraviolet curable resin and electron curable resin can be listed. As the hydrophilic resin, polyvinylalcohol, cellulose derivative, casein, gelatin, styren-maleic acid unhydride, carboxy-denatured polyethylene resin can be lised.

As the hydrophilic emulsion and the hydrophobic resin, polyacetic acid vinyl, polyurethane, vinyl chloride/vinyl acetate copolymer, polyester, polybutylaccrelate, polyvinylacetal, ethylene/vinylacetate copolymer can be listed. One of those compounds solely or a mixture of several of the compounds can be employed. Also, hardener can be used with those compound if necessary.

An image to be recorded on the transparent thermal recording medium according to the present invention can be formed in various ways by using, for example, a thermal pen, a thermal head, laser heating, or thermal etching with light, according to a purpose of image usage. In practice it is preferable that the thermal head is employed to form the image.

The transparent thermal recording medium is suitable for a thermal recording medium for a block copy.

As a thermal recording medium siutabel for a block copy, a thermal recording medium for a bock copy, comprising, a supporting member, and a thermal recording layer provided on said supporting member, said thermal recording layer including an electron-donating chromophoric compound, an electron-accepting compound and a binder resin, wherein said thermal recording medium has a high light transmission factor at a wavelength ranging from 350 nm to 700 nm, a color-producing imaging portion of said thermal recording medium formed by thermal energy having absorption peaks at a wavelength ranging from 350 nm to 470 nm and a wavelength ranging from 470 nm to 700 nm respectively, a difference in light transmission factor between said color-producing imaging portion and a non-imaging portion being over 35%, can be used.

Also, a thermal recording medium for a block copy, comprising, a supporting member, and a thermal recording layer provided on said supporting member, said thermal recording layer including an electron-donating chromophoric compound, an electron-accepting compound and a binder resin, wherein said thermal recording medium has a high light transmission factor at a wavelength ranging from 350 nm to 700 nm, a color-producing imaging portion of said thermal recording medium formed by thermal energy having absorption peaks at a wavelength ranging from 350 nm to 470 nm and a wavelength ranging from 470 nm to 700 nm respectively, a difference in light transmission factor between said color-producing imaging portion and a non-imaging portion being over 35% at a wavelength ranging from 380 nm to 620 nm can be used.

Further, a thermal recording medium for a block copy, comprising, a transparent supporting member, and a thermal recording layer provided on said transparent supporting member, said thermal recording layer including an electron-donating chromophoric compound, an organic phosphoric compound and a binder resin having a refractive index ranging from 1.45 to 1.60, said binder resin including a hydroxyl group and/or a carboxyl group in a molecule thereof, and a protective layer provided on said thermal recording layer, said protective layer including a resin having a similar refractive index to that of said binder resin at ordinary temperature, wherein a difference in light transmission factor between a said color-producing imaging portion formed by a thermal energy and a non-imaging portion being over 35% at a wavelength ranging from 350 nm to 470 nm can be used.

Moreover, a thermal recording medium for a block copy, comprising a transparent supporting member, and a thermal recording layer provided on said transparent supporting member, said thermal recording layer including an electron-donating chromophoric compound, an organic phosphoric compound and a binder resin having a refractive index ranging from 1.45 to 1.60, said binder resin including a hydroxyl group and/or a carboxyl group in a molecule thereof, and a protective layer provided on said thermal recording layer, said protective layer including a resin having a similar refractive index to that of said binder resin at ordinary temperature, wherein a difference in light transmission factor between a said color-producing imaging portion formed by a thermal energy and a non-imaging portion being over 35% at a wavelength ranging from 380 nm to 440 nm. However, the present invention is not limited to the above-described mediums.

A detail description of the present invention will be given by referring to non-limiting examples hereinafter.

Terms "parts" and "%" written in the following examples are based on weight.

EXAMPLE 1

An applied liquid for the recording layer was prepared by dispersing the following composition with a desk-top type ball mill so as to yield a 0.3-μm average particle size of octadecylphosphonic acid.

| [Applied liquid for recording layer] | |
|---|---|
| 3-diethylamino-6-methyl-7-anilinofluoran | 10 parts |
| Octadecylphosphonic acid | 30 parts |
| Polyvinylbutyral [refractive index 1.49] (Denkabutyral #3000-2 produced by Denka Kagaku Kogyo Corp.) | 15 parts |
| Mixed liquid of toluene/methylethylketone (ratio 1/1) | 285 parts |

An applied liquid for the protective layer was prepared by dispersing the following composition homogeneously.

| [Applied liquid for protective layer] | |
|---|---|
| 75% of urethane acrylate ultraviolet curable resin Solution of acetate-n-butyl [refractive index 1.49] (Unidick C7-157 produced by Dainihon Ink Kagaku Corp.) | 100 parts |
| Solution of 52% silicone resin xylene (Byk-344 produced by Bic Chemy Japan Corp.) | 4 parts |
| Ethylacetate | 50 parts |

[Production of transparent thermal recording medium]

The applied liquid for the recording layer was applied and dried on a 100-μm HPJ polyester film (produced by Teijin Corp.) by a wired-bar so as to yield a 6.0-μm thickness of the applied coating layer, and thus forming the thermal recording layer. Further, the applied liquid for the protective layer was applied and dried on the thermal recording layer with the wired bar, and then hardened with a 80-W/cm ultraviolet ray lamp to form the protective layer of about a 6.0-μm thickness. Thus a transparent thermal recording medium was produced.

EXAMPLE 2

An applied liquid for the recording layer was prepared by dispersing the following composition with the desk-top type ball mill so as to yield the 0.3-μm average particle size of octadecylphosphonic acid.

| [Applied liquid for recording layer] | |
|---|---|
| 2-(o-chlorophenylamino)-6-ethylamino-7-methylfluoran | 10 parts |
| Octadecylphosphonic acid | 30 parts |
| Polyvinylbutyral [refractive index 1.49] (Denkabutyral #3000-2 produced by Denka Kagaku Kogyo Corp.) | 15 parts |
| Mixed liquid of toluene/methylethylketone (ratio 1/1) | 285 parts |

An applied liquid for the protective layer was prepared by dispersing the following composition homogeneously.

| [Applied liquid for protective layer] | |
|---|---|
| 75% of urethane acrylate ultraviolet curable resin Solution of acetate-n-butyl [refractive index 1.56] (Unidick C7-157 produced by Dainihon Ink Kagaku Corp.) | 10 parts |
| Solution of 52% silicone resin xylene (Byk-344 produced by Bic Chemy Japan Corp.) | 4 parts |
| Ethylacetate | 50 parts |

[Production of transparent thermal recording medium]

The applied liquid for the recording layer was applied and dried on the 100-μm HPJ polyester film (produced by Teijin Corp.) by the wired-bar so as to yield the 8.0-μm thickness of the applied coating layer, and thus forming the thermal recording layer. Further, the applied liquid for the protective layer was applied and dried on the thermal recording layer with the wired bar, and then hardened with the 80-W/cm ultraviolet ray lamp to form the protective layer of the about 6.0-μm thickness. Thus a transparent thermal recording medium was produced.

EXAMPLE 3

An applied liquid for the recording layer was prepared by dispersing the following composition with the desk-top type ball mill so as to yield a 0.3-μm average particle size of eycosylphosphonic acid.

| [Applied liquid for recording layer] | |
|---|---|
| 2-(o-chlorophenylamino)-6-n-octylaminofluoran | 10 parts |
| Eycosylphosphonic acid | 30 parts |
| Polyvinylbutyral [refractive index 1.49] (Denkabutyral #3000-2 produced by Denka Kagaku Kogyo Corp.) | 15 parts |
| Mixed liquid of toluene/methylethylketone (ratio 1/1) | 285 parts |

An applied liquid for the protective layer was prepared by dispersing the following composition homogeneously.

| [Applied liquid for protective layer] | |
|---|---|
| 75% of urethane acrylate ultraviolet curable resin Solution of acetate-n-butyl [refractive index 1.56] (Unidick C7-157 produced by Dainihon Ink Kaqaku Corp.) | 100 parts |
| Solution of 52% silicone resin xylene (Byk-344 produced by Bic Chemy Japan Corp.) | 4 parts |
| Ethylacetate | 50 parts |

[Production of transparent thermal recording medium]

The applied liquid for the recording layer was applied and dried on the 100-μm HPJ polyester film (produced by Teijin Corp.) by the wired bar so as to yield the 8.0-μm thickness of the applied coating layer, and thus forming the thermal recording layer. Further, the applied liquid for the protective layer was applied and dried on the thermal recording layer with the wired-bar, and then hardened with the 80-W/cm ultraviolet ray lamp to form the protective layer of about the 6.0-μm thickness. Thus a transparent thermal recording medium was produced.

EXAMPLE 4

An applied liquid for the recording layer was prepared by dispersing the following composition with the desk-top type ball mill so as to yield the 0.3-μm average particle size of eycosylphosphonic acid.

| [Applied liquid for recording layer] | |
|---|---|
| 2-(o-nitrophenylamino)-6-diethylaminofluoran | 10 parts |
| Eycosylphosphonic acid | 30 parts |
| Polyvinylbutyral [refractive index 1.49] (Denkabutyral #3000-2 produced by Denka Kagaku Kogyo Corp.) | 15 parts |
| Mixed liquid of toluene/methylethylketone (ratio 1/1) | 285 parts |

An applied liquid for the protective layer was prepared by dispersing the following composition homogeneously.

| [Applied liquid for protective layer] | |
|---|---|
| 75% of urethane acrylate ultraviolet curable resin Solution of acetate-n-butyl [refractive index 1.56] (Unidick C7-157 produced by Dainihon Ink Kagaku Corp.) | 100 parts |
| Solution of 52% silicone resin xylene (Byk-344 produced by Bic Chemy Japan Corp.) | 4 parts |
| Ethylacetate | 50 parts |

[Production of transparent thermal recording medium]

The applied liquid for the recording layer was applied and dried on the 100 μm HPJ polyester film (produced by Teijin Corp.) by the wired-bar so as to yield the 8.0-μm thickness of the applied coating layer, and thus forming the thermal recording layer. Further, the applied liquid for the protective layer was applied and dried on the thermal recording layer with the wired bar, and then hardened with the 80-W/cm of ultraviolet ray lamp to form the protective layer of about the 6.0-μm thickness. Thus a transparent thermal recording medium was produced.

EXAMPLE 5

An applied liquid for the recording layer was prepared by dispersing the following composition with the desk-top type ball mill so as to yield the 0.3-μm average particle size of octadecylphosphonic acid.

| [Applied liquid for recording layer] | |
|---|---|
| 2-amino-3-methyl-6-di-n-butylaminofluoran | 10 parts |
| Octadecylphosphonic acid | 30 parts |
| Polyvinylbutyral [refractive index 1.49] (Denkabutyral #3000-2 produced by Denka Kagaku Kogyo Corp.) | 15 parts |
| Mixed liquid of toluene/methylethylketone (ratio 1/1) | 285 parts |

An applied liquid for the protective layer was prepared by dispersing the following composition homogeneously.

| [Applied liquid for protective layer] | |
|---|---|
| 75% of urethane acrylate ultraviolet curable resin Solution of acetate-n-butyl [refractive index 1.56] (Unidick C7-157 produced by Dainihon Ink Kaqaku Corp.) | 100 parts |
| Solution of 52% silicone resin xylene (Byk-344 produced by Bic Chemy Japan Corp.) | 4 parts |
| Ethylacetate | 50 parts |

[Production of transparent thermal recording medium]

The applied liquid for the recording layer was applied and dried on the 100 μm HPJ polyester film (produced by Teijin Corp.) by the wired bar so as to yield the 8.0-μm thickness of the applied coating layer, and thus forming the thermal recording layer. Further, the applied liquid for the protective layer was applied and dried on the thermal recording layer with the wired-bar, and then hardened with the 80-W/cm ultraviolet ray lamp to form the protective layer of about the 6.0-μm thickness. Thus a transparent thermal recording medium was produced.

EXAMPLE 6

An applied liquid for the recording layer was prepared by dispersing the following composition with the desk-top type ball mill so as to yield the 0.3-μm average particle size of octadecylphosphonic acid.

| [Applied liquid for recording layer] | |
|---|---|
| 2-phenylamino-3-methyl-6-di-n-butylaminofluoran | 10 parts |
| Octadedylphosphonic acid | 30 parts |
| Polyvinylbutyral [refractive index 1.49] (Denkabutyral #3000-2 produced by Denka Kagaku Kogyo Corp.) | 15 parts |
| Mixed liquid of toluenelmethylethylketone (ratio 1/1) | 285 parts |

An applied liquid for the protective layer was prepared by dispersing the following composition homogeneously.

| [Applied liquid for protective layer] | |
|---|---|
| 75% of urethane acrylate ultraviolet curable resin | 100 parts |
| Solution of acetate-n-butyl [refractive index 1.56] (Unidick C7-157 produced by Dainihon Ink Kagaku Corp.) | |
| Solution of 52% silicone resin xylene (Byk-344 produced by Bic Chemy Japan Corp.) | 4 parts |
| Ethylacetate | 50 parts |

[Production of transparent thermal recording medium]

The applied liquid for the recording layer was applied and dried on the 100-μm HPJ polyester film (produced by Teijin Corp.) by the wired bar so as to yield the 8.0-μm thickness of the applied coating layer, and thus forming the thermal recording layer. Further, the applied liquid for the protective layer was applied and dried on the thermal recording layer with the wired bar, and then hardened with the 80-W/cm ultraviolet ray lamp to form the protective layer of about the 6.0-μm thickness. Thus a transparent thermal recording medium was produced.

EXAMPLE 7

An applied liquid for the recording layer was prepared by dispersing the following composition with the desk-top type ball mill so as to yield the 0.3-μm average particle size of octadecylphosphonic acid.

| [Applied liquid for recording layer] | |
|---|---|
| 2-(N-methyl-N-3'-chlorophenylamino)-6-ethylamino-7-methylfluoran | 10 parts |
| Octadecylphosphonic acid | 30 parts |
| Polyvinylbutyral [refractive index 1.49] (Denkabutyral #3000-2 produced by Denka Kagaku Kogyo Corp.) | 15 parts |
| Mixed liquid of toluene/methylethylketone (ratio 1/1) | 285 parts |

An applied liquid for the protective layer was prepared by dispersing the following composition homogeneously.

| [Applied liquid for protective layer] | |
|---|---|
| 75% of urethane acrylate ultraviolet curable resin | 100 parts |
| Solution of acetate-n-butyl [refractive index 1.56] (Unidick C7-157 produced by Dainihon Ink Kagaku Corp.) | |
| Solution of 52% silicone resin xylene (Byk-344 produced by Bic Chemy Japan Corp.) | 4 parts |
| Ethylacetate | 50 parts |

[Production of transparent thermal recording medium]

The applied liquid for the recording layer was applied and dried on the 100 μm HPJ polyester film (produced by Teijin Corp.) by the wired bar so as to yield the 8.0-μm thickness of the applied coating layer, and thus forming the thermal recording layer. Further, the applied liquid for the protective layer was applied and dried on the thermal recording layer with the wired bar, and then hardened with the 80-W/cm ultraviolet ray lamp to form the protective layer of about the 6.0-μm thickness. Thus a transparent thermal recording medium was produced.

EXAMPLE 8

An applied liquid for the recording layer was prepared by dispersing the following composition with the desk-top type ball mill so as to yield the 0.3-μm average particle size of eycosylphosphonic acid.

| [Applied liquid for recording layer] | |
|---|---|
| 2-phenylamino-3-methyl-6-ethylamino-7-methylfluoran | 10 parts |
| Eycosylphosphonic acid | 30 parts |
| Polyvinylbutyral [refractive index 1.49] (Denkabutyral #3000-2 produced by Denka Kagaku Kogyo Corp.) | 15 parts |
| Mixed liquid of toluene/methylethylketone (ratio 1/1) | 285 parts |

An applied liquid for the protective layer was prepared by dispersing the following composition homogeneously.

| [Applied liquid for protective layer] | |
|---|---|
| 75% of urethane acrylate ultraviolet curable resin | 100 parts |
| Solution of acetate-n-butyl [refractive index 1.56] (Unidick C7-157 produced by Dainihon Ink Kaqaku Corp.) | |
| Solution of 52% silicone resin xylene (Byk-344 produced by Bic Chemy Japan Corp.) | 4 parts |
| Ethylacetate | 50 parts |

[Production of transparent thermal recording medium]

The applied liquid for the recording layer was applied and dried on the 100-μm HPJ polyester film (produced by Teijin Corp.) by the wired-bar so as to yield the 8.0-μm thickness of and thus forming layer, and thus forming the thermal recording layer. Further, the applied liquid for the protective layer was applied and dried on the thermal recording layer with the wired-bar, and then hardened with the 80-W/cm ultraviolet ray lamp to form the protective layer of about the 6.0-μm thickness. Thus a transparent thermal recording medium was produced.

EXAMPLE 9

An applied liquid for the recording layer was prepared by dispersing the following composition with the desk-top type ball mill so as to yield the 0.3-μm average particle size of octadecylphosphonic acid.

| [Applied liquid for recording layer] | |
|---|---|
| 2-benzylamino-3-chloro-6-ethylamino-7-methylfluoran | 10 parts |
| Octadecylphosphonic acid | 30 parts |
| Polyvinylbutyral [refractive index 1.49] (Denkabutyral #3000-2 produced by Denka Kagaku Kogyo Corp.) | 15 parts |
| Mixed liquid of toluene/methylethylketone (ratio 1/1) | 285 parts |

An applied liquid for the protective layer was prepared by dispersing the following composition homogeneously.

| [Applied liquid for protective layer] | |
|---|---|
| 75% of urethane acrylate ultraviolet curable resin | 10 parts |
| Solution of acetate-n-butyl (refractive index 1.56] (Unidick C7-157 produced by Dainihon Ink Kagaku Corp.) | |
| Solution of 52% silicone resin xylene (Byk-344 produced by Bic Chemy Japan Corp.) | 4 parts |
| Ethylacetate | 50 parts |

[Production of transparent thermal recording medium]

The applied liquid for the recording layer was applied and dried on the 100-μm HPJ polyester film (produced by Teijin Corp.) by the wired bar so as to yield the 8.0-μm thickness of the applied coating layer, and thus forming the thermal recording layer. Further, the applied liquid for the protective layer was applied and dried on the thermal recording layer with the wired-bar, and then hardened with the 80-W/cm ultraviolet ray lamp to form the protective layer of about the 6.0-μm thickness. Thus a transparent thermal recording medium was produced.

EXAMPLE 10

An applied liquid for the recording layer was prepared by dispersing the following composition with the desk-top type ball mill so as to yield the 0.3-μm average particle size of octadecylphosphonic acid.

| [Applied liquid for recording layer] | |
|---|---|
| 2-(3',4'-dichlorophenylamino)-6-ethylamino-7-methylfluoran | 10 parts |
| Octadecylphosphonic acid | 30 parts |
| Polyvinylbutyral [refractive index 1.49] (Denkabutyral #3000-2 produced by Denka Kagaku Kogyo Corp.) | 15 parts |
| Mixed liquid of toluene/methylethylketone (ratio 1/1) | 285 parts |

An applied liquid for the protective layer was prepared by dispersing the following composition homogeneously.

| [Applied liquid for protective layer] | |
|---|---|
| 75% of urethane acrylate ultraviolet curable resin Solution of acetate-n-butyl [refractive index 1.56] (Unidick C7-157 produced by Dainihon Ink Kagaku Corp.) | 100 parts |
| Solution of 52% silicone resin xylene (Byk-344 produced by Bic Chemy Japan Corp.) | 4 parts |
| Ethylacetate | 50 parts |

[Production of transparent thermal recording medium]

The applied liquid for the recording layer was applied and dried on the 100-μm HPJ polyester film (produced by Teijin Corp.) by the wired bar so as to yield the 8.0-μm thickness of the applied coating layer, and thus forming the thermal recording layer. Further, the applied liquid for the protective layer was applied and dried on the thermal recording layer with the wired-bar, and then hardened with the 80-W/cm ultraviolet ray lamp to form the protective layer of about the 6.0-μm thickness. Thus a transparent thermal recording medium was produced.

EXAMPLE 11

An applied liquid for the recording layer was prepared by dispersing the following compositions with the desk-top type ball mill so as to yield a 0.3 μm average particle size of eycosylphosphonic acid.

| [Applied liquid for recording layer] | |
|---|---|
| 2-(o-chlorophenylamino)-6-n-octylaminofuran | 10 prats |
| Eycosylphosphonic acid | 30 parts |
| Styrene/maleic acid monoisobutyle ester copolymer [refractive index 1.57, produced by Gifu Cerac Corp.) 15 parts Mixed liquid of toluene/methylethylketone (ratio 1/4) | 284 parts |

An applied liquid for the protective layer was prepared by dispersing the following compositions homogeneously.

[Applied liquid for protective layer]

75% of urethane acrylate ultraviolet curable resin [refractive index 1.56] n-butyl acetate solution (Unidick C7-157 produced by Dainihon Ink Kagaku Corp.] 100 parts Xylene solution of 52% sillicone resin (Byk-344 produced by Byk Chemy Japan Corp.) 4 parts Colloidal silica gel (Mizucasil P-527 produced by MizusawaKagaku Corp.) 20 parts Ethylacetate 50 parts [Production of transparent thermal recording medium]

The applied liquid for the recording layer was applied and dried on the 75 μm Melinex 705 polyester film (produced by ICI Japan Inc.) by the wired bar so as to yield the 8.0 μm thickness of the applied coating layer, and thus forming the thermal recording layer. Further, the applied liquid for the protective layer was applied and dried on the thermal recording layer with the wired-bar, and then hardened with the 80 W/cm ultraviolet ray lamp to form the protective layer of about the 4.0 μm thickness. Thus, a transparent thermal recording medium was produced.

EXAMPLE 12

An applied liquid for the recording layer was prepared by dispersing the following compositions with the desk-top type ball mill so as to yield a 0.3 μm average particle size of octadecylphosphonic acid.

| [Applied liquid for recording layer] | |
|---|---|
| 2-amino-3-methyl-6-butylaminofluoran | 16 parts |
| Octadecylphosphonic acid | 30 parts |
| Polyvinylbutyral [refractive index 1.49] (Denkabutyral #3000-2 produced by Denka Kagaku Kogyo Corp.) | 10 parts |
| Styrene/maleic acid monoisobutyle ester copolymer [refractive index 1.57, produced by Gifu Cerac Corp.] 5 parts Mixed liquid of toluene/methylethylketone (ratio 1/4) | 285 parts |

An applied liquid for the protective layer was prepared by dispersing the following compositions homogeneously.

| [Applied liquid for protective layer] | |
|---|---|
| Silicone-denatured polyvinylbutyral (SP-712 produced by Dainichiseika Corp., solid content 12.5%) | 84 parts |
| Mixed liquid of toluene/methylethylketone (ratio 1/2) | 200 parts |
| [Applied liquid for antistatic layer] | |
| SnO2-Sb/vinyl chloride resin (ELCOM 3519-3 produced by Shokubai Kasei Kogyo Inc.) | 20 parts |
| Mixed liquid of toluene/methylethylketone (ratio 1/1) | 80 parts |

[Production of transparent thermal recording medium]

The applied liquid for the antistatic layer was applied and dried on one side of the 75 μm Melinex 705 polyester film (produced by ICI Japan Corp.) by the wired-bar so as to yield the 0.3 μm thickness of the applied antistatic layer. The applied liquid for the recording layer is applied and dried on the other side of the polyester film by the wired-bar so as to yield the 8.0 μm thickness of the applied coating layer, and thus forming the thermal recording layer. Further, the applied liquid for the protective layer was applied and dried on the thermal recording layer with the wired-bar to form the protective layer of about the 2.0 μm thickness. Thus, a transparent thermal recording medium was produced.

Control 1

An applied liquid for the recording layer was prepared by dispersing the following composition with the desk-top type ball mill so as to yield a 1.3 μm average particle size of octadecylphosphonic acid.

| [Applied liquid for recording layer] | |
|---|---|
| 3-diethylamino-6-methyl-7-anilinofluoran | 10 parts |
| Octadecylphosphonic acid | 30 parts |
| Polyvinylbutyral [refractive index 1.49] (Denkabutyral #3000-2 produced by Denka Kagaku Kogyo Corp.) | 15 parts |
| Mixed liquid of toluene/methylethylketone (ratio 1/1) | 285 parts |

[Production of thermal recording medium]

The applied liquid for the recording layer was applied and dried on the 100 μm HPJ polyester film (produced by Teijin Corp.) by the wired bar, and thus a thermal recording medium was produced.

Control 2

A transparent thermal recording medium according to the control 2 was prepared similarly to the example 1 except that polyvinylbutyral was replaced with a polyvinyl chloride-vinyl acetate copolymer [refractive index: 1.54] (UYHH: produced by Union Carbite Corp.).

Control 3

A transparent thermal recording medium according to the control 3 was prepared similarly to the example 1 except that polyvinylbutyral was replaced with saturated polyester Byron 300[refractive index: 1.56] (produced by Toyobo Corp.).

Control 4

A transparent thermal recording medium according to the control 4 was prepared similarly to the example 1 except that polyvinylbutyral was replaced with acryl resin Dianal BR-85[refractive index: 1.49] (produced by Mitsubishi Kasei Corp.).

An energy having a power of 0.7 W/dot and a pulse width of 0.5 msec was applied to the thermal recording media, which had been produced in the above-mentioned ways, by a printer using a thermal head of 8 dot/mm so as to record images on the media. Then the recorded images were evaluated by the following tests.

[Color Tone]

A color tone for each of the recorded images were visually inspected immediately after being recorded.

[Transmission Density]

An image density and a non-printed surface density for each of the recorded images were measured by a transparent densitometer X-Rite310TR (produced by X-RITE COMPANY) operating with VISUAL mode.

[Spectral Transmission Factor]

Spectral transmission factors for a color-imaging portion and a non-imaging portion (non-printed surface) of the thermal recording media were measured by a spectrophotometer UV-3100 produced by Simazu Seisakusyo at spectral wavelengths of 380 nm, 440 nm and 550 nm.

[Continuous Heat Resistance]

After the thermal recording media were preserved at 60° C. in a dry environment for 24 hours, transmission rates for the color-imaged portion and the non-imaged portion of the thermal recording media were measured.

Results of the above-mentioned tests will be given in the following Table 1.

TABLE 1

| | | ITEM | | | | | | | | | |
|---|---|---|---|---|---|---|---|---|---|---|---|
| | | TRANSMISSION DENSITY (%) | | NON-IMAGED SPECTRAL TRANSMISSION RATE (%) | | | IMAGED SPECTRAL TRANSMISSION RATE (%) | | | CONTINUOUS HEAT RESISTANCE | |
| SAMPLE | COLOR TONE | NON-IMAGE | IMAGE | 380 nm | 440 nm | 559 nm | 380 nm | 440 nm | 550 nm | NON-IMAGE | IMAGE |
| EX. 1 | BLACK | 0.06 | 1.48 | 76 | 80 | 81 | 5.5 | 0.8 | 1.3 | 0.07 | 1.47 |
| EX. 2 | REDISH BROWN | 0.07 | 1.33 | 67 | 71 | 76 | 0.5 | 0.05 | 0.2 | 0.06 | 1.37 |
| EX. 3 | REDISH BROWN | 0.06 | 1.25 | 71 | 76 | 81 | 2 | 0.3 | 0.8 | 0.06 | 1.15 |
| EX. 4 | REDISH BROWN | 0.06 | 1.28 | 60 | 62 | 80 | 5 | 0.7 | 1.0 | 0.06 | 1.20 |
| EX. 5 | REDISH BROWN | 0.06 | 1.08 | 75 | 77 | 83 | 8 | 2 | 2.0 | 0.06 | 1.05 |
| EX. 6 | REDISH BROWN | 0.06 | 1.35 | 69 | 73 | 81 | 2 | 0.4 | 0.9 | 0.06 | 1.30 |
| EX. 7 | BROWN | 0.06 | 1.18 | 70 | 76 | 79 | 0.6 | 0.04 | 0.7 | 0.06 | 1.15 |
| EX. 8 | BROWN | 0.15 | 1.59 | 61 | 51 | 62 | 1.3 | 0.01 | 0.3 | 0.16 | 1.61 |
| EX. 9 | REDISH BROWN | 0.09 | 1.04 | 68 | 70 | 74 | 0.9 | 0.7 | 0.1 | 0.09 | 1.05 |
| EX. 10 | BLACKISH GREEN | 0.19 | 1.73 | 59 | 55 | 65 | 0.5 | 0.03 | 0.2 | 0.21 | 1.80 |
| EX. 11 | REDISH BROWN | 0.15 | 1.30 | 65 | 70 | 75 | 1.8 | 0.2 | 0.9 | 0.13 | 1.25 |
| EX. 12 | REDISH BROWN | 0.12 | 1.20 | 60 | 67 | 77 | 2.0 | 0.25 | 0.7 | 0.12 | 1.17 |
| CONT. 1 | BLACK | 0.15 | 0.92 | 48 | 52 | 80 | 12 | 8 | 10 | 0.15 | 0.91 |
| CONT. 2 | BLACK | 0.05 | 0.79 | 74 | 78 | 81 | 20 | 15 | 32 | 0.05 | 0.36 |
| CONT. 3 | BLACK | 0.05 | 0.75 | 73 | 77 | 81 | 22 | 17 | 40 | 0.05 | 0.30 |
| CONT. 4 | BLACK | 0.05 | 0.63 | 74 | 78 | 80 | 25 | 20 | 31 | 0.05 | 0.37 |

Applications

The film produced in the above-mentioned examples, in which the images were formed thereon with the thermal head were used for positive films (block copy films) for screen process printing, and thus blocks for the screen process printing were produced. Images were printed on the blocks with an easy mimeograph machine and the block copy films were evaluated on a capability for printing.

Furthermore, two block copy films, on which the same image had been formed, were superimposed and a capability for visual inspection of the superimposed images was evaluated. The following Table 2 illustrates results of the applications.

TABLE 2

| | Positive Film Sample | Print | Inspection |
|---|---|---|---|
| Application 1 | Example 1 | YES | a little bad |
| Application 2 | Example 2 | YES | YES |
| Application 3 | Example 3 | YES | YES |
| Application 4 | Example 4 | YES | YES |
| Application 5 | Example 5 | YES | YES |
| Application 6 | Example 6 | YES | YES |
| Application 7 | Example 7 | YES | YES |
| Application 8 | Example 8 | YES | YES |
| Application 9 | Example 9 | YES | YES |
| Application 10 | Example 10 | YES | a little bad |
| Application 11 | Example 11 | YES | YES |
| Application 12 | Example 12 | YES | YES |
| Application 13 | Control 1 | NO | NO |
| Application 14 | Control 2 | NO | NO |
| Application 15 | Control 3 | NO | NO |
| Application 16 | Control 4 | NO | NO |

Therefore, the transparent thermal recording medium according to the present invention can be effectively used for the block copy film, on which the image are formed, for plate-making, particularly, in photogravure, offset printing and screen process printing, because the transparent thermal recording medium has the contrast of light transmission factors between the color-imaging portion and the non-imaging portion, in which the contrast is not less than 50% at the wavelength ranging from 370 nm to 450 nm.

Further, the present invention is not limited to the above-described embodiments, and variations and modifications may be made without departing from the scope of the present invention.

What is claimed is:

1. A transparent thermal recording medium comprising: a thermal recording layer, which is provided on a transparent layer, consisting essentially of an electron-donating chromophoric compound selected from the group of fluoran compounds consisting of formulas (III), (IV), (V), (VI), (VII) and (VIII):

(III)

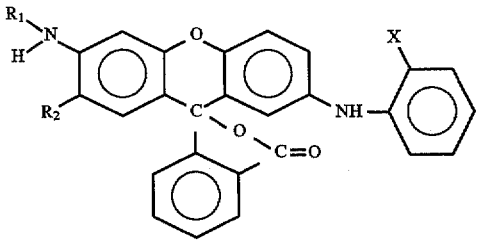

wherein $R_1$ is selected from alkyl group≦8 carbon atoms, $R_2$ is selected from a hydrogen atom and an alkyl group having≦4 carbon atoms, and X is a halogen atom selected from the group consisting of fluorine, chlorine and bromine;

(IV)

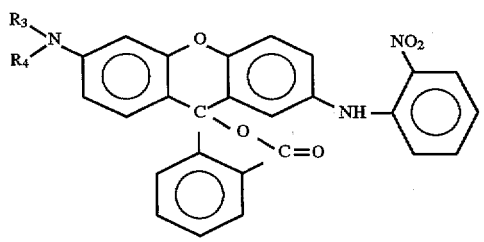

where $R_3$ is hydrogen or an alkyl group having≦8 carbon atoms, and $R_4$ is an alkyl group having≦8 carbon atoms;

(V)

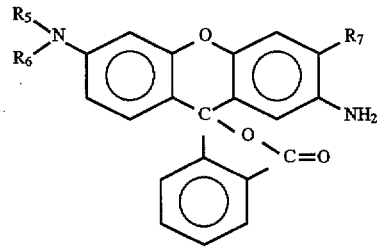

where $R_5$ and $R_6$ are each an alkyl group having≦8 carbon atoms, and $R_7$ is hydrogen, lower alkyl, or lower alkoxy;

(VI)

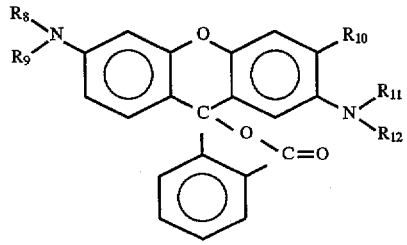

where $R_8$ is hydrogen, $R_9$ is an alkyl group having≦8 carbon atoms, $R_{10}$ is hydrogen, lower alkyl or lower alkoxy, $R_{11}$ is hydrogen or an alkyl group having≦8 carbon atoms, and $R_{12}$ is an alkyl group having≦8 carbon atoms, phenyl or substituted phenyl;

(VII)

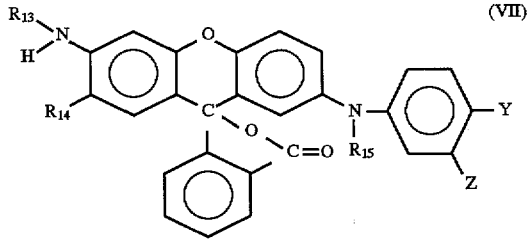

where $R_{13}$ is an alkyl group having≦8 carbon atoms, $R_{14}$ is methyl or ethyl, $R_{15}$ is hydrogen or an alkyl group having≦4 carbon atoms, and Y and Z are each a halogen atom selected from the group consisting of fluorine, chlorine and bromine;

(VIII)

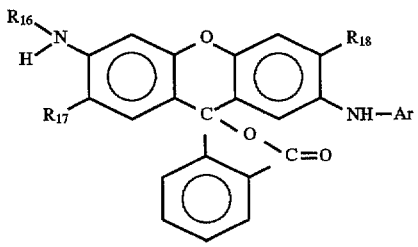

where $R_{16}$ is an alkyl group having≦8 carbon atoms, $R_{17}$ is methyl or ethyl, $R_{18}$ is an alkyl group having≦4 carbon atoms or a halogen atom selected from the group consisting of chlorine and bromine, and Ar is phenyl or benzyl; an electron-accepting compound and binder resin; and a further-provided protective layer having an approximately equal refractive index to the refractive index of said thermal recording layer, wherein said binder resin is a compound having a hydroxyl group and/or a carboxyl group.

2. The transparent thermal recording medium as claimed in claim 1, wherein the refractive index of said binder resin and the refractive index of resin forming said protective layer range from 1.45 to 1.60 at ordinary temperature.

3. The transparent thermal recording medium as claimed in claim 1, wherein said electron-accepting compound is an organophosphoric acid compound.

4. The transparent thermal recording medium as claimed in claim 3, wherein said organophosphoric acid compound is selected from the group of phosphonic acid compounds consisting of the formula (II) and formula (II):

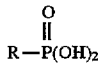

(I)

where R is a linear alkyl group having from 16 to 24 carbon atoms; and

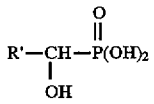

(II)

where R' is a linear alkyl group having from 13 to 23 carbon atoms.

5. A transparent thermal recording medium comprising: a thermal recording layer provided on a transparent support, wherein said thermal recording layer consists essentially of an electron-donating chromophoric compound selected from the group of fluoran compounds consisting of the formulas (III), (IV), (V), (VI), (VII) and (VIII):

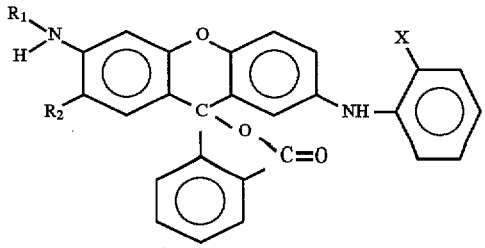

(III)

where $R_1$ is selected from alkyl groups having≦8 carbon atoms, $R_2$ is selected from a hydrogen atom and an alkyl group having≦4 carbon atoms, and X is a halogen atom selected from the group consisting of fluorine, chlorine and bromine;

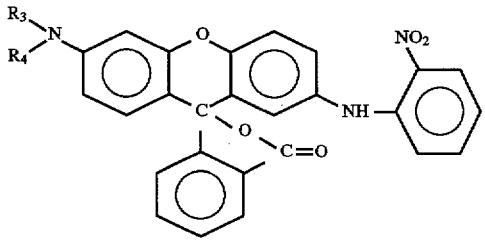

(IV)

where $R_3$ is hydrogen or an alkyl group having≦8 carbon atoms, and $R_4$ is an alkyl group having≦8 carbon atoms;

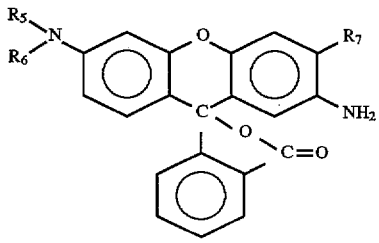

(V)

where $R_5$ and $R_6$ are each an alkyl group having≦8 carbon atoms, and $R_7$ is hydrogen, lower alkyl or lower alkoxy;

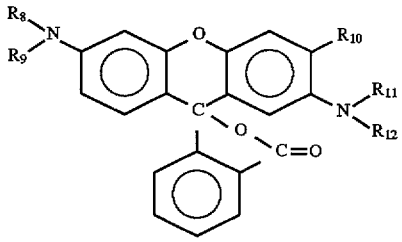

(VI)

where $R_8$ is hydrogen, $R_9$ is an alkyl group having≦8 carbon atoms, $R_{10}$ is hydrogen, lower alkyl or lower alkoxy, $R_{11}$ is hydrogen or alkyl group having≦8 carbon atoms, and $R_{12}$ is an alkyl group having≦8 carbon atoms, phenyl or substituted phenyl;

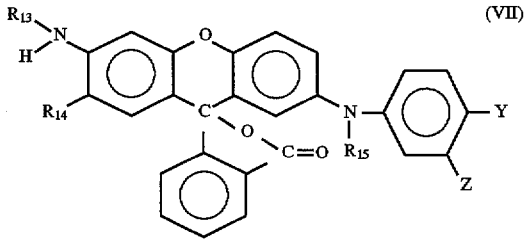

(VII)

where $R_{13}$ is an alkyl group having≦8 carbon atoms, $R_{14}$ is methyl or ethyl, $R_{15}$ is hydrogen or an alkyl group having≦4 carbon atoms, and Y and Z are each a halogen selected from the group consisting of fluorine, chlorine or bromine; and

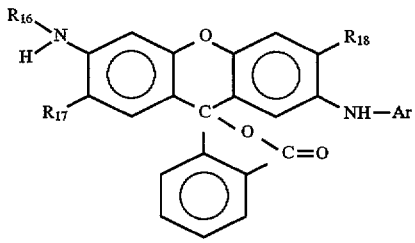

(VIII)

where $R_{16}$ is an alkyl group having≦8 carbon atoms, $R_{17}$ is methyl or ethyl, $R_{18}$ is an alkyl group having≦4 carbon atoms or a halogen atom selected from the group consisting of fluorine, chlorine, and bromine, and Ar is phenyl or benzyl; an organophosphoric acid compound and binder resin having a refractive index ranging from 1.45 to 1.60 at ordinary temperature and including a hydroxyl group and/or a carboxyl group; and a protective layer provided on said thermal recording layer, said protective layer consisting essentially of resin having a refractive index ranging from 1.45 to 1.60 at ordinary temperature.

6. A thermal recording medium for a block copy, comprising:

a transparent supporting member, and a thermal recording layer provided on said transparent supporting member, said thermal recording layer including an electron-donating chromophoric compound selected from the group of fluoran compounds consisting of formulas (III), (IV), (V), VI), (VII) and (VIII):

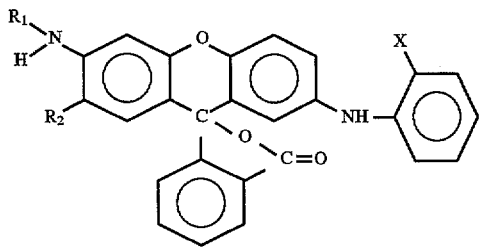

(III)

where $R_1$ is selected from alkyl groups having≦8 carbon atoms, $R_2$ is selected from a hydrogen atom and an alkyl group having≦4 carbon atoms, and X is a halogen atom selected from the group consisting of fluorine, chlorine and bromine;

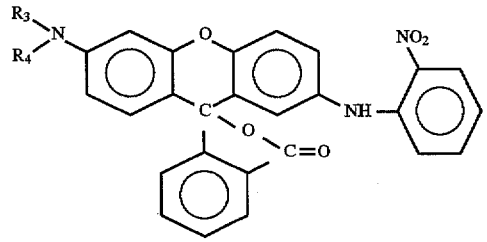

(IV)

where $R_3$ is hydrogen or an alkyl group having≦8 carbon atoms, and $R_4$ is an alkyl group having≦8 carbon atoms;

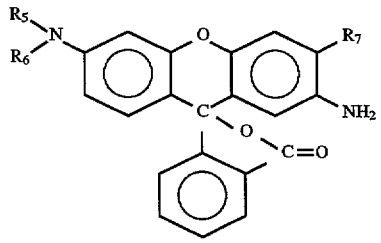

(V)

where $R_5$ and $R_6$ are each an alkyl group having≦8 carbon atoms, and $R_7$ is hydrogen, lower alkyl or lower alkoxy;

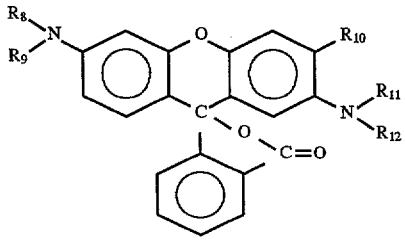

(VI)

where $R_8$ is hydrogen, $R_9$ is alkyl group having≦8 carbon atoms, $R_{10}$ is hydrogen, lower alkyl or lower alkoxy, $R_{11}$ is hydrogen or an alkyl group having≦8 carbon atoms, and $R_{12}$ an alkyl group having≦8 carbon atoms, phenyl or substituted phenyl;

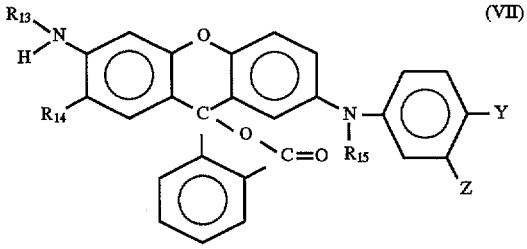

(VII)

where $R_{13}$ is an alkyl group having≦8 carbon atoms, $R_{14}$ is methyl or ethyl, $R_{15}$ is hydrogen or an alkyl group having≦4 carbon atoms, and Y and Z are each a halogen atom selected from the group consisting of fluorine, chlorine and bromine; and

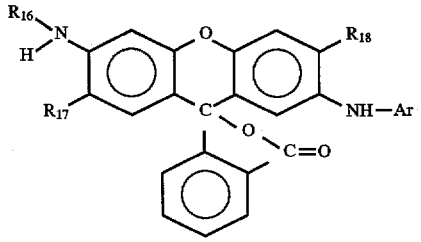

(VIII)

where $R_{16}$ is an alkyl group having≦8 carbon atoms, $R_{17}$ is methyl or ethyl, $R_{18}$ is an alkyl group having≦4 carbon atoms or a halogen atom selected from the group consisting of fluorine, chlorine and bromine, and Ar is phenyl or benzyl; an organic phosphoric compound and a binder resin having a refractive index ranging from 1.45 to 1.60, said binder resin including a hydroxyl group and/or carboxyl group in a molecule thereof, and a protective layer provided on said thermal recording layer, said protective layer including a resin having a similar refractive index to that of said binder resin at ordinary temperature, wherein the difference in light transmission factor between a color-producing imaging portion formed by thermal energy and a non-imaging portion is over 35% at a wavelength ranging from 350 nm to 470 nm.

7. A thermal recording medium for a block copy, comprising:

a transparent supporting member, and a thermal recording layer provided on said transparent supporting member, said thermal recording layer including an electron-donating chromophoric compound selected from the group of fluoran compounds consisting of formulas (III), (IV), (V), (VI), (VII) and (VIII):

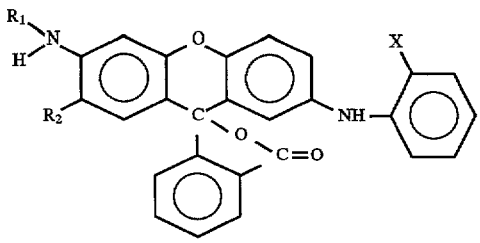

(III)

where $R_1$ is selected from alkyl groups having≦8 carbon atoms, $R_2$ is selected from a hydrogen atom and an alkyl group having≦4 carbon atoms, and X is a halogen atom selected from the group consisting of fluorine, chlorine and bromine;

(IV)

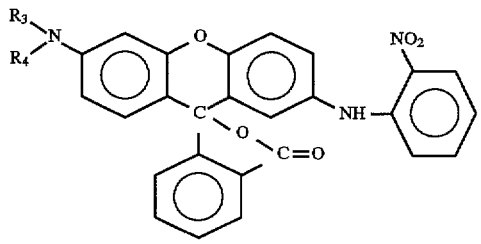

where $R_3$ is hydrogen or an alkyl group having≦8 carbon atoms, and $R_4$ is an alkyl group having≦8 carbon atoms;

(V)

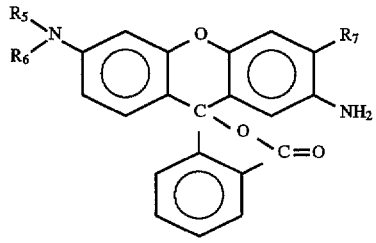

where $R_5$ and $R_6$ are each an alkyl group having≦8 carbon atoms, and $R_7$ is hydrogen, lower alkyl or lower alkoxy;

(VI)

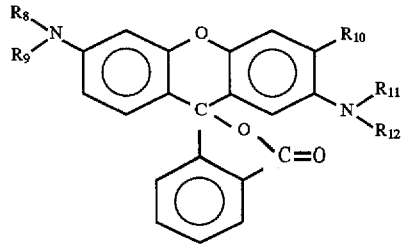

where $R_8$ is hydrogen, $R_9$ is an alkyl group having≦8 carbon atoms, $R_{10}$ is hydrogen, lower alkyl, or lower alkoxy, $R_{11}$ is hydrogen or an alkyl group having≦8 carbon atoms, and $R_{12}$ is an alkyl group having≦8 carbon atoms, phenyl or substituted phenyl;

(VII)

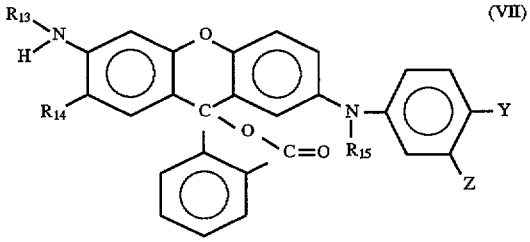

where $R_{13}$ is an alkyl group having≦8 carbon atoms, $R_{14}$ is methyl or ethyl, $R_{15}$ is hydrogen or an alkyl group having≦4 carbon atoms, and Y and Z are each a halogen atom selected from the group consisting of fluorine, chlorine and bromine; and (VIII)

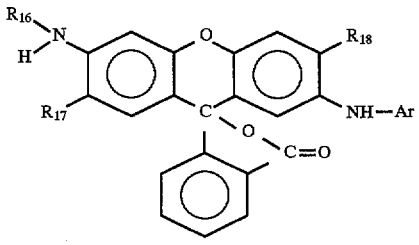

where $R_{16}$ is an alkyl group having≦8 carbon atoms, $R_{17}$ is methyl or ethyl, $R_{18}$ is an alkyl group having≦4 carbon atoms or a halogen atom selected from the group consisting of fluorine, chlorine and bromine, and Ar is phenyl or benzyl; an organic phosphoric compound and a binder resin having a refractive index ranging from 1.45 to 1.60, said binder resin including a hydroxyl group and/or a carboxyl group in a molecule thereof, and a protective layer provided on said thermal recording layer, said protective layer including a resin having a similar refractive index to that of said binder resin at ordinary temperature, wherein a difference in light transmission factor between a color-producing imaging portion formed by thermal energy and a non-imaging portion being over 35% at a wavelength ranging from 380 nm to 440 nm.

* * * * *